US005261492A

United States Patent [19]

Duell et al.

[11] Patent Number: 5,261,492

[45] Date of Patent: Nov. 16, 1993

[54] WELL CASING APPARATUS AND METHOD

[75] Inventors: Alan B. Duell, Duncan, Okla.; Anthony M. Badalamenti, New Orleans, La.; Jonathan Garrett, Covington, La.; Chris P. Christensen, River Ridge, La.; Douglas K. Vrooman, Covington, La.

[73] Assignee: Halliburton Company, Duncan, Okla.

[21] Appl. No.: 861,199

[22] Filed: Mar. 31, 1992

[51] Int. Cl.[5] ..... E21B 23/02

[52] U.S. Cl. ..... 166/387; 166/128; 166/134; 175/326

[58] Field of Search ..... 166/120, 127, 131, 138, 166/143, 128, 196, 114, 133, 191, 195, 196, 387

[56] References Cited

U.S. PATENT DOCUMENTS

| | | | |
|---|---|---|---|
| Re. 28,641 | 12/1975 | Chenoweth | 166/120 |
| 3,094,169 | 6/1963 | Conrad | 166/138 |
| 3,189,096 | 6/1965 | Phenix | 166/133 |
| 3,223,169 | 12/1965 | Roark | 166/138 |
| 3,398,796 | 8/1968 | Fisher, Jr. et al. | 166/127 |
| 3,437,142 | 4/1969 | Conover | 166/387 |
| 4,151,875 | 5/1979 | Sullaway | 166/126 |
| 4,156,460 | 5/1979 | Crowe | 166/120 |
| 4,372,390 | 2/1983 | Baugh et al. | 166/143 |
| 4,545,431 | 10/1985 | Fore | 166/183 |
| 4,576,230 | 3/1986 | Tapp et al. | 166/138 |
| 4,590,995 | 5/1986 | Evans | 166/127 |
| 4,605,062 | 8/1986 | Klumpyan et al. | 166/131 |
| 4,619,319 | 10/1986 | Ringgenberg | 166/55.1 |
| 4,627,488 | 12/1986 | Szarka | 166/51 |
| 4,627,491 | 12/1986 | Zunkel | 166/126 |
| 4,722,400 | 2/1988 | Burns | 166/131 |
| 4,793,411 | 12/1988 | Zunkel | 166/98 |
| 4,834,184 | 5/1989 | Streich et al. | 166/376 |
| 4,928,762 | 5/1990 | Manke | 166/192 |
| 4,968,184 | 11/1990 | Reid | 405/225 |

OTHER PUBLICATIONS

"Hughes Production Tools", vol. 2, 1986–1987, p. 3060, Composite Catalog.

"TIW SN-AT Liner Packer", vol. 4, 1986–1987, Composite Catalog, p. 6108.

*Primary Examiner*—Ramon S. Britts
*Assistant Examiner*—Frank S. Tsay
*Attorney, Agent, or Firm*—James R. Duzan; Dennis Brown

[57] ABSTRACT

The present invention provides an apparatus for casing a well. The inventive apparatus comprises: an outer casing; an inner casing positionable inside the outer casing; and a squeeze packer assembly incorporatable in the inner casing. The squeeze packer assembly is mechanically operable for sealing the annulus between the inner casing and the outer casing.

The present invention also provides a method of installing an inner casing inside an outer casing. The inventive method comprises the steps of: (a) incorporating a mechanically operable squeeze packer assembly in the inner casing and (b) inserting the inner casing into the outer casing.

27 Claims, 8 Drawing Sheets

WELL CASING APPARATUS AND METHOD

FIELD OF THE INVENTION

In one aspect, the present invention relates to methods and apparatus for casing wells. In another aspect, the present invention relates to packing assemblies useful in well casing procedures. In yet another aspect, the present invention relates to methods of installing one casing inside of another casing.

BACKGROUND OF THE INVENTION

A well casing is typically placed in a well bore in order to protect the well bore from collapse and to facilitate the performance of various downhole operations. When the casing is positioned in the well bore, a cement slurry is typically pumped into the space (i.e., the annulus) existing between the wall of the well bore and the outer surface of the casing. Once hardened, the cement operates to prevent the cross-contamination of various underground formations through which the well bore extends, to protect the exterior of the casing from corrosive chemical attack, and to prevent well blowouts and fires which could otherwise be caused by the flow of high pressure gas through the annulus.

As is also known in the art, it is sometimes necessary to install a small diameter casing inside a large diameter casing. In a two-stage drilling operation, for example, a large diameter well bore is first drilled to a suitable depth using a large diameter drill bit. The large diameter well bore is then cased by (1) inserting a large diameter casing therein and (2) cementing the large diameter casing in place by pumping a cement slurry down the interior of the large diameter casing such that the cement slurry flows out of the lower end of the casing and then up into the annulus between the casing and the wall of the well bore. Next, a small diameter drill bit is lowered through the large diameter casing. The small diameter drill bit is used to drill a deep, small diameter well bore extending from the bottom of the large diameter well bore. The small diameter well bore is then cased by (1) inserting a small diameter casing therein such that the small diameter casing extends through the large diameter casing and into the small diameter well bore and (2) cementing the small diameter casing in place by pumping a cement slurry down the interior of the small diameter casing such that the cement slurry flows out of the lower end of the small diameter casing and then up into both (a) the annulus existing between the small diameter casing and the wall of the small diameter well bore and (b) the annulus existing between the small diameter casing and the interior surface of the large diameter casing.

In addition to cement, those skilled in the art will sometimes use one or more inflatable packers to seal the annulus between an inner casing and an outer casing. Gases, water, and/or other fluids can migrate through the cement column which fills the inner casing/outer casing annulus. Consequently, inflatable packers are also placed in the inner casing/outer casing annulus in order to halt the upward migration of these gases and fluids.

An inflatable packer suitable for incorporation in a well casing will typically be comprised of: an elongate tubular housing having a passageway extending longitudinally therethrough; means, provided at one end of the housing, for threadingly connecting the housing to the end of a first casing joint; means, provided at the other end of the housing, for threadingly connecting the housing to the end of a second casing joint; an inflatable packer element positioned around the exterior of the housing; and a housing port extending through the wall of the housing for filling the inflatable packer element with fluid (i.e., for inflating the packer element). When the inflatable packer is first inserted into the well, the packer housing port is temporarily closed by means of a knockoff pin which extends into the interior of the packer housing.

In order to seal the annulus between an inner casing and an outer casing using both cement and an inflatable packer, the inflatable packer is incorporated in the inner casing as the inner casing is inserted into the well. After the inner casing has been fully inserted into the well, a cement slurry slug is pumped into the inner casing. Next, a rubber plug is inserted into the inner casing. The rubber plug is pushed down the inner casing by pumping water, or some other fluid, into the inner casing. As the plug travels down the inner casing, the plug cleans the interior wall of the inner casing and forces the cement slurry slug out of the lower end of the inner casing into the inner casing/outer casing annulus. When the cement slurry travels up the inner casing/outer casing annulus, a portion of the slurry flows around the exterior of the inflatable packer so that the cement column placed in the inner casing/outer casing annulus extends from a point above the inflatable packer to a point below the inflatable packer.

As the rubber plug travels down the inner casing, the plug passes through the housing of the inflatable packer and thus removes the knockoff pin from the packer's housing port. The downward travel of the rubber plug through the inner casing eventually ends when the plug lands on top of a float shoe positioned at the bottom of the inner casing. When the rubber plug is positioned on top of the float shoe, the lower end of the inner casing is thus sealed such that, by continuing to pump fluid into the inner casing, the fluid pressure inside the inner casing can be greatly increased.

After the rubber plug lands on top of the float shoe and thus seals the lower end of the inner casing, the inflatable packing element of the packer is inflated by continuing to pump water, or some other fluid, into the inner casing. As the pumping operation continues, the fluid pressure inside the inner casing eventually increases to a point whereby fluid is forced through the packer housing port and into the packer's inflatable packing element. As fluid is forced into the inflatable packing element, the packing element expands (i.e., inflates) outwardly toward and against the interior surface of the outer casing. When the inflatable packing element is thus expanded against the interior surface of the outer casing, the inflated packing element seals the inner casing/outer casing annulus.

SUMMARY OF THE INVENTION

Through the provision and use of mechanically operated packing assemblies, the present invention provides significant advantages over the above-described well casing apparatus and method which utilize an inflatable packer assembly. The packing assemblies and well casing methods of the present invention are considerably less expensive than the above-described method and apparatus which utilize an inflatable packer assembly. Additionally, the present invention provides an inner casing of greater overall integrity than is provided by the above-described method and apparatus which utilize an inflatable packer. As indicated above, the housing of an inflatable packer must have at least one hole extending through the wall thereof so that the inflatable element of the packer can be filled with fluid. Thus, the incorporation of an inflatable packer in a well casing reduces the overall integrity of the casing. However, there are no holes extending through the housing walls of the mechanically operated packer assemblies provided by and used in the present invention.

In one aspect, the present invention provides an apparatus for casing a well. The inventive apparatus comprises an outer casing, an inner casing, and a squeeze packer assembly. The inner casing is positionable inside the outer casing such that an annulus is provided between the inner casing and the outer casing. The squeeze packer assembly is incorporatable in the inner casing. Further, the squeeze packer assembly is mechanically operable for sealing the annulus between the inner casing and the outer casing.

The present invention also provides a packing assembly comprising: an outer member having a passageway extending therethrough; an elongate inner member positionable in said passageway; at least one squeeze packer element positionable adjacent the exterior of the inner member; a squeezing means, positionable adjacent the exterior of the inner member, for squeezing the packer element; a seating member operably associated with the squeezing means; and a contacting means, provided in the passageway of the outer member, for contacting the seating means. The squeezing means of the inventive packing assembly is mechanically operable for squeezing the packer element when the contacting means contacts the seating member.

The present invention additionally provides a packing assembly comprising: an outer member having a passageway extending therethrough; an elongate inner member positionable in said passageway; at least one squeeze packer element positionable adjacent the exterior of the inner member; a squeezing means, positionable adjacent the exterior of the inner member, for squeezing the squeeze packer element, said squeezing means including at least one outwardly biased contacting member; and a receiving means, provided in the passageway of the outer member, for receiving at least a portion of the contacting member. The squeezing means of this inventive packing assembly is mechanically operable for squeezing the packer element when said portion of the contacting member is received in the receiving means.

The present invention further provides a method of installing an inner casing inside an outer casing. The inventive method comprises the steps of: (a) incorporating a mechanically operable squeeze packer assembly in the inner casing and (b) inserting the inner casing in the outer casing.

Further objects, features, and advantages of the present invention will be readily apparent to those skilled in the art upon reference to the accompanying drawings and upon reading the following description of the preferred embodiments.

DESCRIPTION OF THE PREFERRED EMBODIMENTS

Figure 1:
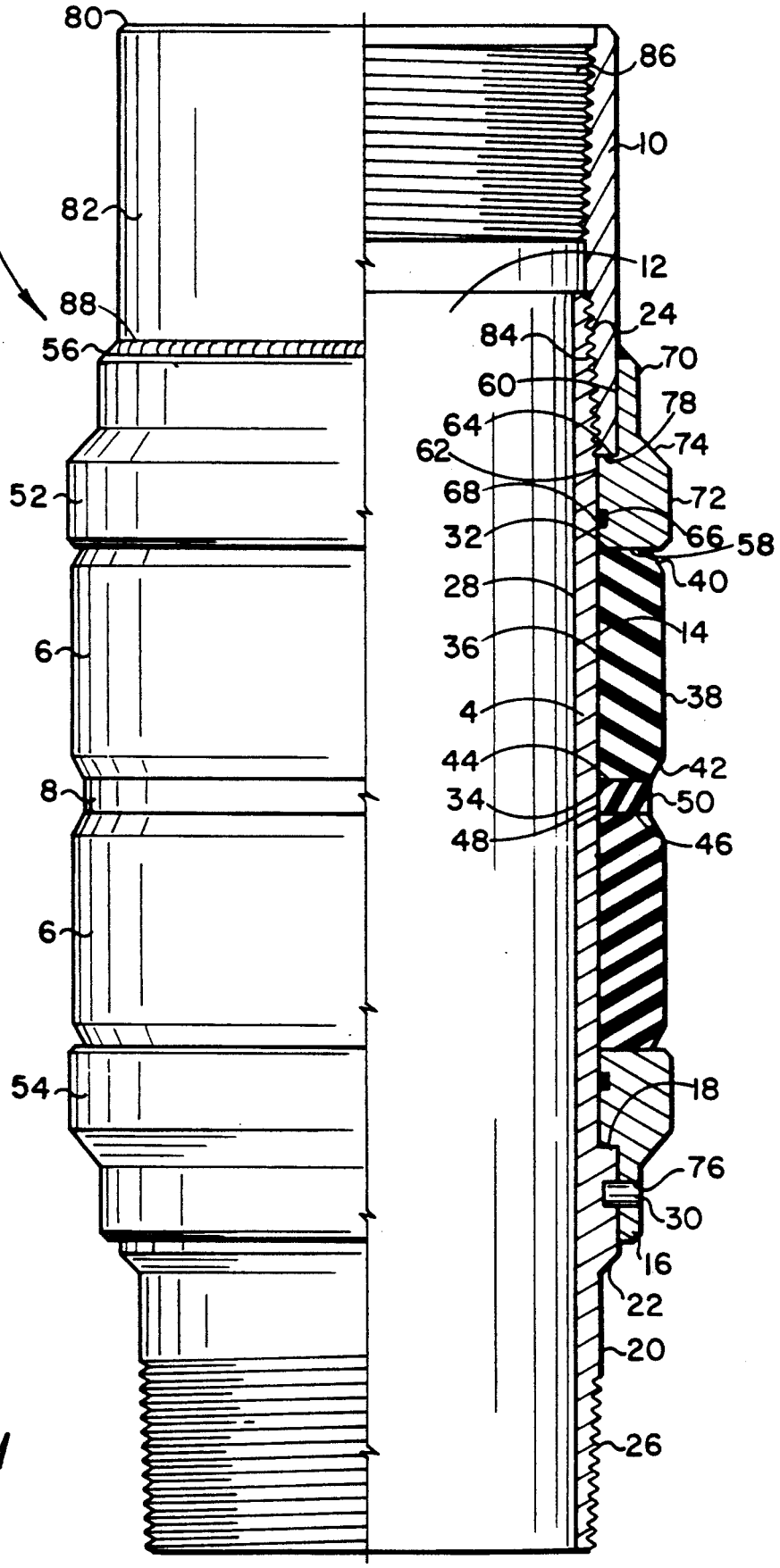
FIG. 1 provides a one-half cutaway elevational side view of an embodiment of a squeeze packer assembly 2 provided by and used in the present invention.
Figure 3:
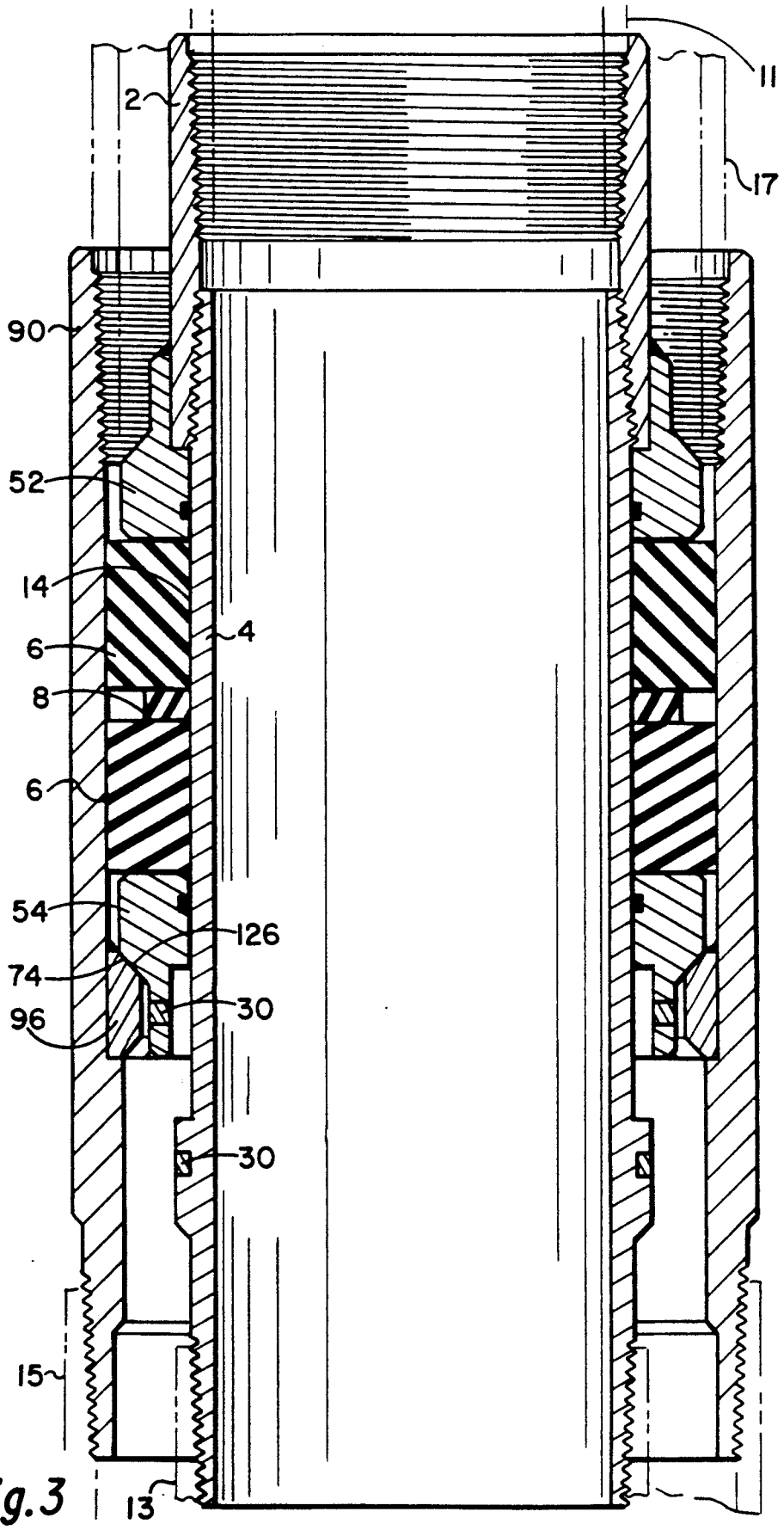
FIG. 3 provides a full cutaway elevational side view of squeeze packer assembly 2 positioned in landing collar assembly 90.

An embodiment of a first squeeze packer assembly 2 provided by and used in the present invention is depicted in FIGS. 1 and 3. Squeeze packer assembly 2 comprises: an elongate cylindrical housing (or mandrel) 4; squeeze packer elements 6 positionable adjacent the exterior of housing 4; a spacer 8 positionable adjacent the exterior of housing 4 between packer elements 6; a squeezing means positionable adjacent the exterior of housing 4 for squeezing packer elements 6; and a coupling 10 for connecting squeeze packer assembly 2 to the end of a first casing joint.

As shown in FIGS. 1 and 3, housing 4 is an elongate cylindrical mandrel having a cylindrical passageway 12 extending longitudinally therethrough. Housing 4 further comprises: a first cylindrical exterior surface 14; a second cylindrical exterior surface 16 adjacent surface 14, surface 16 having an outside diameter greater than the outside diameter of cylindrical exterior surface 14; a radial shoulder 18 defined by the transition from cylindrical exterior surface 14 to cylindrical exterior surface 16; a third cylindrical exterior surface 20 having an outside diameter less than the outside diameter of cylindrical exterior surface 16; a frusto-conical exterior surface 22 extending from cylindrical exterior surface 16 to cylindrical exterior surface 20; a tapered exterior threaded portion 24 adjacent cylindrical exterior surface 14 for threadingly connecting housing 4 to coupling 10; and a second tapered exterior threaded portion 26 adjacent cylindrical exterior surface 20 for threadingly connecting housing 4 to the end of a second casing joint 13 (shown in phantom in FIG. 3). The inside diameter of cylindrical passageway 12 is preferably equivalent to the inside diameter of the casing joints to which squeeze packer assembly 2 is connected. A plurality of (preferably at least four) bores 28 are provided in cylindrical exterior surface 16 for receiving shear pins 30.

Squeeze packer elements 6 are preferably elastomeric compressible packer elements of the type commonly used in the art. As shown in FIGS. 1 and 3, each squeeze packer element comprises: a radial top surface 32; a radial bottom surface 34; a cylindrical interior surface 36 extending from the interior edge of radial surface 32 to the interior edge of radial surface 34; a cylindrical exterior surface 38; a frusto-conical surface 40 extending from the top end of cylindrical exterior surface 38 to the outer edge of radial surface 32; and a frusto-conical surface 42 extending from the bottom end of cylindrical exterior surface 38 to the outer edge of radial surface 34. The inside diameter of cylindrical interior surface 36 is slightly greater than the outside diameter of cylindrical exterior surface 14 of housing 4 such that each squeeze packer element 6 is positionable around exterior surface 14 of housing 4.

As also shown in FIGS. 1 and 3, spacer 8 is a ring-shaped member which is slideably positionable on cylindrical exterior surface 14 of housing 4 between squeeze packer elements 6. Spacer 8 comprises: a radial top surface 44; a radial bottom surface 46; a cylindrical interior surface 48 extending from the inner edge of radial surface 44 to the inner edge of radial surface 46; and a cylindrical exterior surface 50 extending from the outer edge of radial surface 44 to the outer edge of radial surface 46. The inside diameter of cylindrical interior surface 48 is slightly greater than the outside diameter of cylindrical exterior surface 14 of housing 4 so that spacer 8 is positionable around surface 14.

The packer element squeezing means of assembly 2 comprises an upper shoe 52 and a lower shoe (or seating member) 54. Upper shoe 52 and lower shoe 54 each comprise: a first end 56; a radial second end 58; a first cylindrical bore 60 extending from end 56; a second cylindrical bore 62 extending from bore 60 to end 58, bore 62 having an inside diameter smaller than the inside diameter of bore 60; a radial shoulder 64 defined by the transition from bore 60 to bore 62; a groove 66 formed in the interior surface of bore 62 for receiving a sealing means 68; a first cylindrical exterior surface 70 extending from end 56; a second cylindrical exterior surface 72 extending from end 58, surface 72 having an outside diameter greater than the outside diameter of cylindrical exterior surface 70; and a frusto-conical exterior surface 74 extending between cylindrical exterior surface 70 and cylindrical exterior surface 72. A plurality of (preferably at least four) apertures 76 are provided in lower shoe 54 for receiving shear pins 30. The inside diameters of cylindrical bores 62 of shoes 52 and 54 are slightly greater than the outside diameter of cylindrical exterior surface 14 of housing 4 so that shoes 52 and 54 are positionable around surface 14. The inside diameter of bore 60 of lower shoe 54 is slightly greater than the outside diameter of exterior surface 16 of housing 4 such that surface 16 is receivable in bore 60 with shoulder 18 of housing 4 abutting shoulder 64 of shoe 54. As explained hereinbelow, frusto-conical exterior surface 74 of lower shoe 54 functions as a seating surface for the squeezing means of assembly 2.

Coupling 10 comprises: a radial lower end 78; an upper end 80; a cylindrical exterior surface 82 extending from end 78 to end 80; a first bore portion 84 extending from end 78 and having tapered interior threads for threadingly receiving the exterior threaded portion 24 of housing 4; and a second bore portion 86 extending from bore portion 84 to end 80 and having tapered interior threads for threadingly connecting squeeze packer assembly 2 to the end of a first casing joint 11 (shown in phantom in FIG. 3). The outside diameter of exterior surface 82 of coupling 10 is slightly less than the inside diameter of bore 60 of upper shoe 52 so that coupling 10 is receivable in bore 60 with end 78 of coupling 10 abutting shoulder 64 of shoe 52.

Squeeze packer assembly 2 is assembled by first placing lower shoe 54 on housing 4 such that shoulder 64 of shoe 54 abuts shoulder 18 of housing 4 and apertures 76 are aligned with bores 28. Shear pins 30 are then positioned in apertures 76 and bores 28 as shown in FIGS. 1 and 3. Next, squeeze packer elements 6, spacer 8, and upper shoe 52 are positioned on housing 4 as shown in FIGS. 1 and 3. Internally threaded portion 84 of coupling 10 is then threadingly connected to externally threaded portion 24 of housing 4 such that end 78 of coupling 10 abuts shoulder 64 of upper shoe 52. Finally, end 56 of upper shoe 52 is welded to cylindrical exterior surface 82 of coupling 10 at position 88 as shown in FIGS. 1 and 3.

Figure 2:
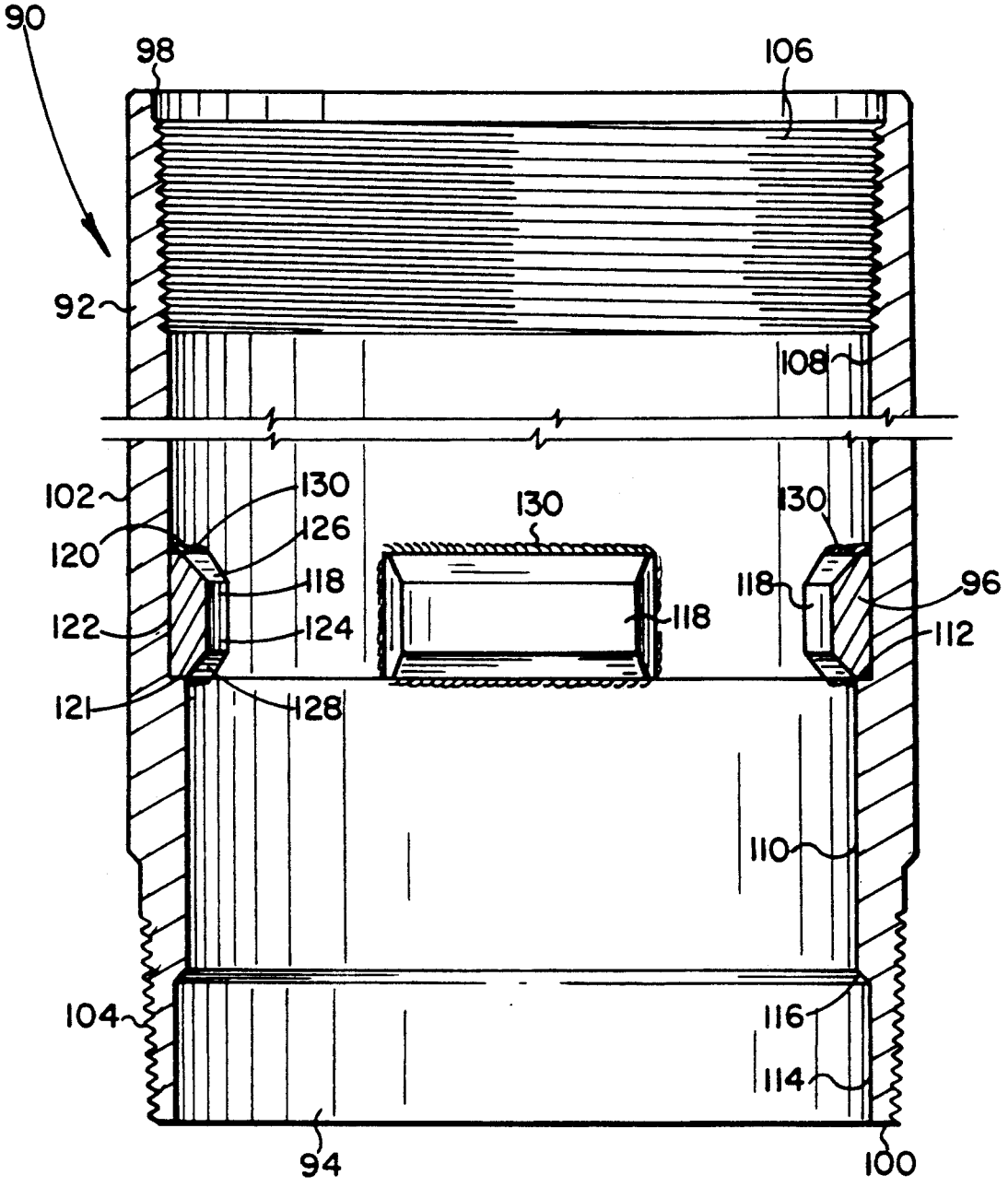
FIG. 2 provides a full cutaway elevational side view of an embodiment of a landing collar assembly 90 provided by and used in the present invention.

An embodiment of a landing collar assembly 90 provided by the present invention and used in the present invention in conjunction with squeeze packer assembly 2 is depicted in FIGS. 2 and 3. Landing collar assembly 90 comprises (a) a housing 92 having a passageway 94 extending longitudinally therethrough and (b) a segmented collar 96 positioned in passageway 94. Housing 92 comprises: a first end 98; a second end 100; a cylindrical exterior portion 102 extending from end 98; a tapered exterior threaded portion 104 extending from cylindrical exterior portion 102 to end 100 for connecting housing 92 to the end of a first casing joint 15 (shown in phantom in FIG. 3); a tapered interior threaded portion 106 extending from end 98 for connecting housing 92 to the end of a second casing joint 17 (shown in phantom in FIG. 3); a first cylindrical bore 108 adjacent interior threaded portion 106; a second cylindrical bore 110 adjacent bore 106, bore 110 having an inside diameter smaller than the inside diameter of bore 108; a radial shoulder 112 defined by the transition from bore 108 to bore 110; a third cylindrical bore 114 extending from end 100; and a frusto-conical surface 116 extending between second cylindrical bore 110 and third cylindrical bore 114.

Segmented collar 96 comprises a plurality of collar segments 118. Each collar segment 118 comprises an upper surface 120; a lower surface 121; a semi-cylindrical outer surface 122 extending from the outer edge of upper surface 120 to the outer edge of lower surface 121; a semi-cylindrical inner surface 124; a tapered surface 126 extending from inner surface 124 to the inner edge of upper surface 120; and a tapered surface 128 extending from inner surface 124 to the inner edge of lower surface 121. Collar segments 118 are placed in housing 92 such that the lower surfaces 121 of collar segments 118 abut shoulder 112 of housing 92. When collar segments 118 are thus positioned in housing 92, each collar segment 118 is welded to the surface of cylindrical bore 108 of housing 92 and to shoulder 112 as shown at 130.

Landing collar assembly 90 preferably utilizes four collar segments 118, each collar segment 118 extending over ⅛ of the perimeter of cylindrical bore 108 of housing 92. As shown in FIG. 2, landing collar segments 118 are preferably evenly spaced about the perimeter of cylindrical bore 108.

The various components of landing collar assembly 90 are sized such that: (1) the lower end of squeeze packer assembly 2 can be inserted into bore 108 of housing 92 and through segmented collar 96; (2) when the lower end of squeeze packer assembly 2 is thus inserted in housing 92 of landing collar assembly 90, tapered surfaces 126 of collar segments 118 will contact seating surface 74 of lower shoe 54 such that lower shoe 54 is prevented from traveling through segmented collar 96; and (3) when squeeze packer assembly 2 is positioned in landing collar assembly 90 and packing elements 6 of squeeze packer assembly 2 are not compressed, a cement slurry can be caused to flow around the exterior of squeeze packer assembly 2.

When (a) squeeze packer assembly 2 is incorporated in a first casing (i.e., a small diameter inner casing), (b) landing collar assembly 90 is incorporated in a second casing (i.e., a large diameter outer casing), and (c) said first casing is lowered into said second casing such that tapered surfaces 126 of collar 96 contact seating surface 74 of lower shoe 54, squeeze packer assembly 2 can be mechanically operated to seal the annulus between squeeze packer assembly 2 and landing collar assembly 90. As used herein and in the claims, a device incorporated in a casing is "mechanically operable" when it can be activated by lifting, turning, and/or lowering the casing.

When squeeze packer assembly 2 is positioned in landing collar assembly 90 in the manner just described, assembly 2 can be mechanically operated by a simple "lowering" process wherein at least a portion of the weight of said first casing is allowed to rest on assembly 2. During this lowering process, coupling 10, housing 4, and upper shoe 52 of squeeze packer assembly 2 are urged downward by the weight of said first casing. However, due to the contact between seating surface 74 and surfaces 126 of segmented collar 96, lower shoe 54 of assembly 2 is maintained in fixed position in landing collar assembly 90. Consequently, shear pins 30 are severed during the lowering process and packer elements 6 are compressed between upper shoe 52 and lower shoe 54. As shown in FIG. 3, the compression of packer elements 6 under the weight of said first casing urges elements 6 into sealing engagement with interior surface 106 of landing collar assembly 90.

In one embodiment of the method of the present invention, squeeze packer assembly 2 and landing collar assembly 90 are used to facilitate the installation of a small diameter casing inside a large diameter casing. In this embodiment of the inventive method, landing collar assembly 90 is incorporated in the large diameter casing as the large diameter casing is inserted into a well bore. The large diameter casing is then cemented in place by pumping a cement slurry down the interior of the large diameter casing such that the cement slurry flows through the lower end of the large diameter casing and then upward into the annulus between the exterior of the large diameter casing and the interior wall of the well bore. Next, squeeze packer assembly 2 is incorporated in the small diameter casing as the small diameter casing is inserted into the large diameter casing. The small diameter casing is lowered in the large diameter casing until seating surface 74 of lower shoe 54 contacts surfaces 126 of collar 96. A cement slurry is then pumped down the interior of the small diameter casing such that the cement slurry flows through the lower end of the small diameter casing and then up into the annulus between the small diameter casing and the large diameter casing. As the cement slurry flows up the small diameter/large diameter casing annulus, a portion of the cement slurry flows around the exterior of squeeze packer assembly 2 such that the column of cement placed in the small diameter casing/large diameter casing annulus extends from a point above squeeze packer assembly 2 to a point below assembly 2. When the cement slurry is in place in the small diameter/large diameter casing annulus, but before the cement begins to harden, the weight of the small diameter casing is allowed to rest on squeeze packer assembly 2 such that shear pins 30 of assembly 2 are severed, collar 10, housing 4, and upper shoe 52 of assembly 2 are urged downward relative to lower shoe 54, and packer elements 6 are thus compressed and urged tightly against interior surface 106 of landing collar assembly 90.

In order to ensure that packing elements 6 remain in sealing engagement with interior surface 106 of landing collar assembly 90, the weight of the small diameter casing should be allowed to rest on squeeze packer assembly 2 until the cement in the large diameter/small diameter casing annulus is well hardened.

As will thus be apparent to those skilled in the art, inventive assemblies 2 and 90 and the method of the present invention are well suited for use in two-stage drilling processes of the type described hereinabove.

Figures 4, 4A, 4B, 4C:
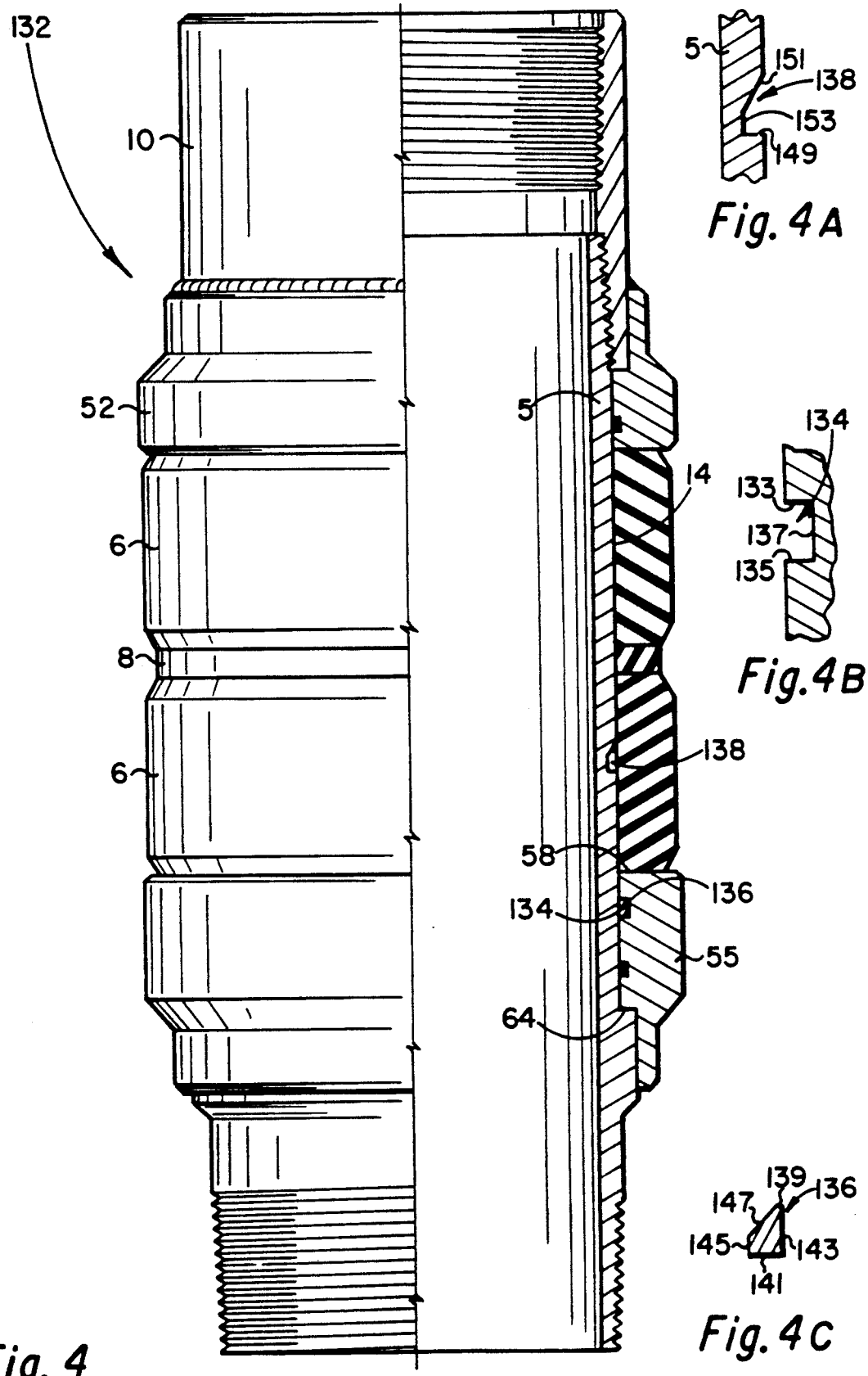
FIG. 4 provides a one-half cutaway elevational side view of an embodiment of a second squeeze packer assembly 132 provided by and used in the present invention.
FIG. 4A provides a cross-sectional view of groove 138 of assembly 132.
FIG. 4B provides a cross-sectional view of groove 134 of assembly 132.
FIG. 4C provides a cross-sectional view of locking ring 136 of assembly 132.

An embodiment of a second squeeze packer assembly 132 provided by and used in the present invention is depicted in FIG. 4. Except for (1) slight modifications to its housing 5 and lower shoe 55 and (2) the addition of a resilient locking ring 136, squeeze packer assembly 132 is identical to squeeze packer assembly 2.

As shown in FIG. 4, the portion of lower shoe 55 of assembly 132 extending from shoulder 64 to end 58 is longer than the corresponding portion of lower shoe 54 of assembly 2. Additionally, a groove 134 is formed in cylindrical interior surface 62 of lower shoe 55 for holding locking ring 136. As shown in FIG. 4B, groove 134 includes a radial upper surface 133, a radial lower surface 135, and a cylindrical surface 137 extending from the outer edge of radial upper surface 133 to the outer edge of radial lower surface 135. The depth of groove 134 is such that locking ring 136 is completely receivable in groove 134. As shown in FIG. 4C, locking ring 136 comprises: an upper edge 139; a lower radial surface 141; an exterior cylindrical surface 143 extending from the outer edge of lower radial surface 141 to upper edge 139; a cylindrical interior surface 145 extending from the inner edge of lower radial surface 141; and an interior frusto-conical surface 147 extending from the upper end of interior surface 145 to upper edge 139.

As shown in FIGS. 4 and 4A, a groove 138 is provided in cylindrical exterior surface 14 of housing 5. Groove 138 is operable for receiving an inside portion of locking ring 136 from groove 134 when packing elements 6 have been placed in sealing (i.e., compressed) position. Groove 138 includes a lower radial surface 149, an upper frusto-conical surface 151, and a cylindrical surface 153 extending from the inner edge of lower radial surface 149 to the lower edge of frusto-conical surface 151. The depth of groove 138 is less than the cross-sectional width of ring 136 so that, when the inside portion of ring 136 is received in groove 138, the outside portion of ring 136 must remain in groove 134 of lower shoe 55.

Squeeze packer assembly 132 can be positioned in landing collar assembly 90 and than mechanically operated, in the same manner as assembly 2, to compress packer elements 6 and thereby seal the annulus between assembly 132 and assembly 90. As the housing 5 of assembly 132 is lowered through the lower shoe 55 of assembly 132 (i.e., as the weight of the small diameter casing in which assembly 132 is incorporated is allowed to rest on assembly 132), housing 5 also travels through locking ring 136. When groove 138 of housing 5 reaches groove 134 of shoe 55, the inside portion of locking ring 136 moves into groove 138. As housing 5 continues to move downward through shoe 55, upper frusto-conical surface 151 of groove 138 pushes against interior frusto-conical surface 147 of locking ring 136 such that the inside portion of ring 136 is urged back into groove 134 of shoe 55. As a result, groove 138 of housing 5 is allowed to travel slightly past groove 134 of shoe 55.

When housing 5 is later caused to move slightly upward through shoe 55 (i.e., when the weight of the small diameter casing is lifted from assembly 132), groove 138 of housing 5 again arrives at groove 134 such that the inside portion of ring 136 moves into groove 138. As housing 5 attempts to move further upward, however, lower radial surface 149 of groove 138 firmly abuts lower radial surface 141 of ring 136 such that upper edge 139 of ring 136 is urged strongly against upper radial surface 133 of groove 134. Locking ring 136 is thus bound between housing 5 and lower shoe 55 such that (a) housing 5 is not allowed to travel further upward through lower shoe 55 and (b) packing elements 6 are thereby locked in compressed position.

In a second embodiment of the method of the present invention, squeeze packer assembly 132 is used in conjunction with landing collar assembly 90 to facilitate the installation of a small diameter casing inside a large diameter casing. This embodiment of the inventive method is substantially identical to the above-described method utilizing landing collar assembly 90 and squeeze packing assembly 2. However, since the locking means of assembly 132 operates to ensure that packing elements 6 of assembly 132 remain in compressed position, the weight of the small diameter casing can be lifted from assembly 132 before the cement in the small diameter/large diameter casing annulus hardens.

Figure 5:
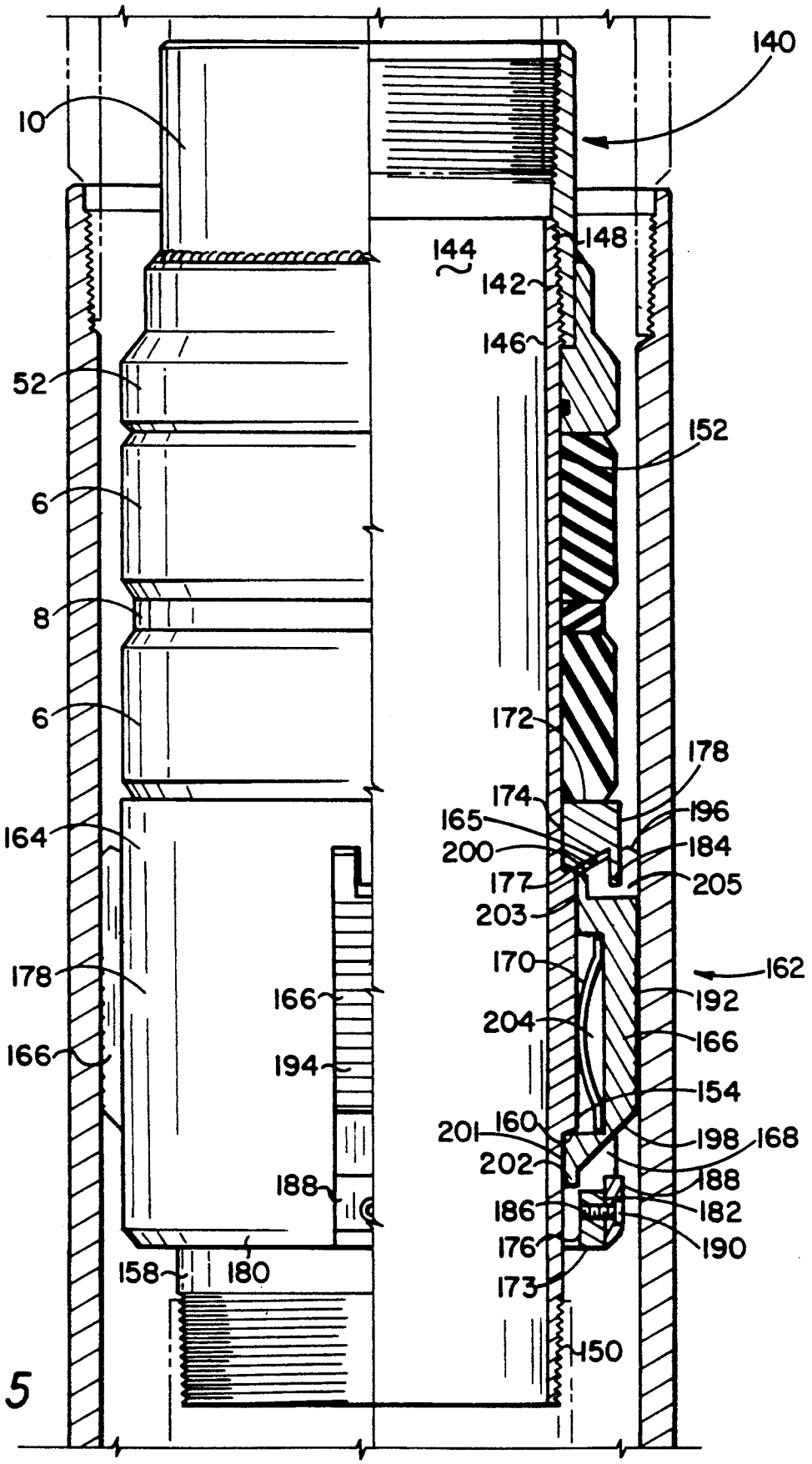
FIG. 5 provides a one-half cutaway elevational side view of an embodiment of a third squeeze packer assembly 140 provided by and used in the present invention.
Figure 6:
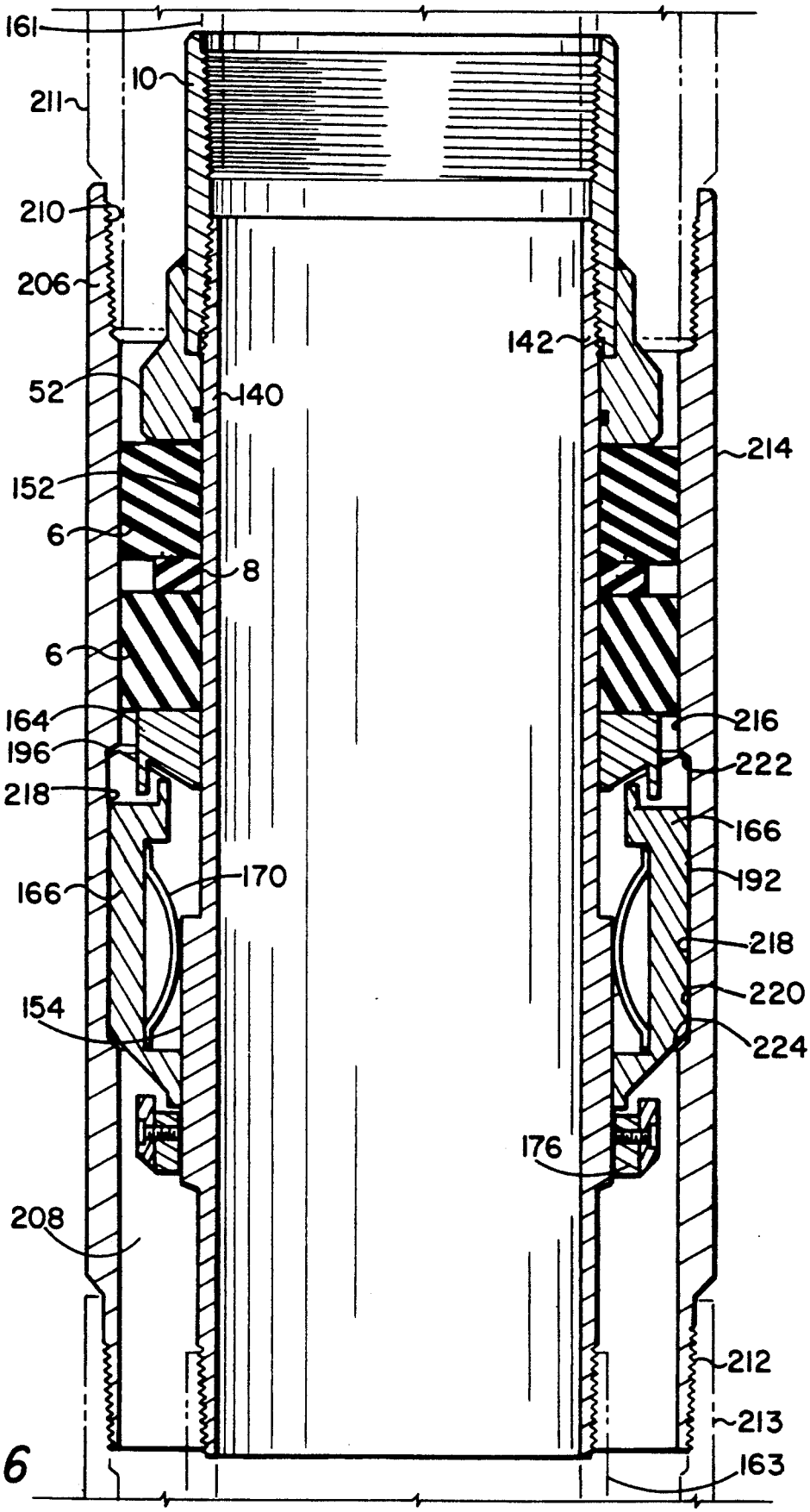
FIG. 6 provides a full cutaway elevational side view of squeeze packer assembly 140 positioned in an embodiment of a receiving collar assembly 206 provided by and used in the present invention.

An embodiment of a third squeeze packer assembly 140 provided by and used in the present invention is depicted in FIGS. 5 and 6. Squeeze packer assembly 140 comprises: an elongate cylindrical housing (or mandrel) 142 having a cylindrical passageway 144 extending longitudinally therethrough; a coupling 10 threadably connectable to the end of housing 142 for connecting assembly 140 to the end of a first casing joint 161 (shown in phantom in FIG. 6); packer elements 6 positionable on the exterior of elongate housing 142; a spacer 8 positionable on the exterior of housing 142 between packer elements 6; and a squeezing means, positionable on the exterior of elongate housing 142, for compressing packer elements 6. Coupling 10, packer elements 6, and spacer 8 are identical to the correspondingly numbered components of squeeze packer assembly 2.

Elongate housing 142 of squeeze packer assembly 140 comprises: a cylindrical interior surface 146; a tapered exterior threaded portion 148 at one end of housing 142 for threadingly connecting housing 142 to coupling 10; a tapered exterior threaded portion 150 at the other end of housing 142 for connecting housing 142 to the end of a second casing joint 163 (shown in phantom in FIG. 6); a first cylindrical exterior surface 152 adjacent threaded portion 148; a second cylindrical exterior surface 154 adjacent cylindrical surface 152, cylindrical surface 154 having an outside diameter larger than the outside diameter of cylindrical surface 152; a shoulder 156 defined by the transition from cylindrical exterior surface 152 to cylindrical exterior surface 154; a third cylindrical exterior surface 158 extending between cylindrical exterior surface 152 and exterior threaded portion 150, exterior surface 158 having an outside diameter smaller than the outside diameter of surface 154; and a radial shoulder 160 defined by the transition from cylindrical exterior surface 154 to cylindrical exterior surface 158. The inside diameter of passageway 144 of housing 142 is preferably equivalent to the inside diameter of the casing in which assembly 140 is incorporated.

The squeezing means of squeeze packer assembly 140 comprises an upper shoe 52 and a lower shoe assembly 162. Upper shoe 52 of squeeze packer assembly 140 is identical to upper shoe 52 of squeeze packer assembly 2. Lower shoe assembly 162 comprises: a drag block sleeve 164 positionable on the exterior of housing 142; drag blocks 166 positionable in apertures 168 formed in sleeve 164; and springs 170 positionable between drag blocks 166 and exterior surface 154 of housing 142 for urging drag blocks 166 outward.

Drag block sleeve 164 comprises: a radial upper surface 172; a radial lower surface 173; a first cylindrical interior surface 174 extending from the inner edge of upper surface 172; a second cylindrical interior surface 176 extending from cylindrical interior surface 174 to the inner edge of lower radial surface 173, cylindrical interior surface 176 having an inside diameter larger than the inside diameter of cylindrical interior surface 174; a radial shoulder 177 defined by the transition from cylindrical interior surface 174 to cylindrical interior surface 176; a cylindrical exterior surface 178 extending from the outer edge of upper radial surface 172; and a frusto-conical surface 180 extending from the lower end of cylindrical exterior surface 178 to the outer edge of lower radial surface 173. Portions 182 are cut away from frusto-conical surface 180 and from the lower portion of cylindrical exterior surface 178 so that drag blocks 166 can be mounted in apertures 168. Apertures 168 for receiving drag blocks 166 extend through drag block sleeve 164 from cylindrical interior surface 176 to cylindrical exterior surface 178. An upwardly tapered surface 165 is provided at the upper end of each aperture 168.

Drag block sleeve 164 also includes projecting fingers 184 which extend into the upper ends of apertures 168. Additionally, threaded apertures 186 are provided in sleeve 164 for installing retaining plates 188 in cutaway portions 182 using screws 190. Retaining plates 188 are installed in cutaway portions 182 after drag blocks 166 are installed in apertures 168. Projecting fingers 164 and retaining plates 188 operate to prevent drag blocks 166 from falling out of apertures 188.

As indicated in FIG. 6, the inside diameter of interior surface 174 of drag block sleeve 164 is slightly greater than the outside diameter of exterior surface 152 of housing 142 such that surface 174 is positionable on surface 152 with shoulder 177 of sleeve 164 abutting shoulder 156 of housing 142. Additionally, the inside diameter of cylindrical interior surface 176 of drag block sleeve 164 is slightly greater than the outside diameter of cylindrical exterior surface 154 of housing 142 such that drag block sleeve 164 is able to slide upward along cylindrical exterior surfaces 152 and 154 of housing 142 as depicted in FIG. 6.

Each drag block 166 of assembly 140 is an elongate member comprising: a tapered top surface 200 having a shape which corresponds to that of surface 165 of drag block sleeve 164; a lower projecting end 202; a lower inside surface 201 extending from lower end 202; an upper inside surface 203 extending from the inside edge of top surface 200; an outside surface 192 having gripping teeth 194 formed therein; a tapered upper surface 196 extending between the upper edge of outside surface 192 and the outside edge of top surface 200; and a tapered lower surface 198 extending between the lower edge of outside surface 192 and lower end 202. A recess 204 is formed in each drag block 166 for cylindrical interior surface 220; and a lower frusto-conical surface 224 extending between cylindrical interior surface 216 and cylindrical interior surface 220.

In a third embodiment of the method of the present invention, squeeze packer assembly 140 and receiving collar 206 are used to facilitate the installation of a small diameter casing inside a large diameter casing. In this embodiment of the inventive method, receiving collar 206 is incorporated in the large diameter casing as the large diameter casing is inserted into a well bore. After the large diameter casing is inserted in the well bore, a cement slurry is pumped down the interior of the large diameter casing such that the slurry flows out of the lower end of the large diameter casing and then up and into the annulus between the large diameter casing and the wall of the well bore. Next, squeeze packer assembly 140 is incorporated in the small diameter casing as the small diameter casing is inserted into the large diameter casing. As squeeze packer assembly 140 travels down the interior of the large diameter casing, springs 170 urge drag blocks 166 against the interior wall of the large diameter casing. When squeeze packer assembly 140 reaches receiving collar 206, drag blocks 166 of assembly 140 expand outwardly into recess 218 of collar 206.

When squeeze packer assembly 140 is positioned in receiving collar 206 in the manner just described, a cement slurry is pumped down the interior of the small diameter casing such that the slurry flows out of the lower end of the small diameter casing and then up and into the annulus between the exterior of the small diameter casing and the interior of the large diameter casing. As the cement slurry travels up the small diameter/-large diameter casing annulus, a portion of the slurry travels between drag blocks 166 and around the remainder of drag block assembly 140. Consequently, the cement column placed in the small diameter/large diameter casing annulus extends from a point above squeeze packer assembly 140 to a point below squeeze packer assembly 140.

After the cement slurry is placed in the small diameter/large diameter casing annulus, but before the slurry receiving a bow spring 170. Recess 204 extends from the lower end of inside surface 203 to the upper end of inside surface 201. Each drag block 166 is sized such that, when lower inside surface 201 is placed flush against exterior surface 158 of housing 142, upper inside surface 203 will rest flush against exterior surface 154 of housing 142. A slot 205 is provided in the upper end of each drag block 166 for receiving a projecting finger 184.

In assembling squeeze packer assembly 140, drag block sleeve 164 is first positioned on elongate housing 142 such that shoulder 177 of sleeve 164 abuts shoulder 156 of housing 142. Packer elements 6, spacer 8, and upper shoe 52 are then positioned above sleeve 164 on housing 142 as depicted in FIG. 5. Subsequently, coupling 10 is threadingly connected to exterior threaded portion 148 of housing 142. Next, drag blocks 166 and springs 170 are positioned in apertures 168 of drag block sleeve 164. Finally, retaining plates 188 are fixed in the cutaway portions 182 of sleeve 164 using screws 190. With retaining plates 188 thus positioned in cutaway portions 182, drag blocks 166 are prevented from falling out of apertures 168.

An embodiment of a receiving collar provided by the present invention and used in the present invention in conjunction with squeeze packer assembly 140 is depicted in FIG. 6. Receiving collar 206 comprises an elongate housing (or mandrel) having a passageway 208 extending longitudinally therethrough. Receiving collar 206 includes: a tapered interior threaded portion 210 at one end thereof for connecting collar 206 to the end of a first casing joint 211 (shown in phantom in FIG. 6); a tapered exterior threaded portion 212 at the other end thereof for connecting collar 206 to the end of a second casing joint 213 (shown in phantom in FIG. 6); a cylindrical exterior surface 214 extending from exterior threaded portion 212 to the upper end of collar 206; a cylindrical interior surface 216 extending from threaded interior portion 210 to the lower end of collar 206; and a recess 218 formed in interior surface 216 for receiving drag blocks 166 as shown in FIG. 6. Recess 218 comprises: a cylindrical interior surface 220; an upper frusto-conical surface 222 extending between cylindrical interior surface 216 and begins to harden, squeeze packer assembly 140 is mechanically operated by a simple "lowering" process in order to seal the annulus between assembly 140 and receiving collar 206. In this lowering process, at least a portion of the weight of the small diameter casing is allowed to rest on squeeze packer assembly 140. With drag blocks 166 positioned in recess 218 of receiving collar 206, drag blocks 166 and drag block sleeve 164 are held in fixed position in collar 206 during the lowering process. However, coupling 10, housing 4, and upper shoe 52 of squeeze packer assembly 140 are urged downward by the weight of the small diameter casing such that packer elements 6 are compressed between upper shoe 52 and drag block sleeve 164 and are thereby urged tightly against interior surface 216 of profile collar 206. When thus compressed against interior surface 216, packer elements 6 operate to seal the small diameter/large diameter casing annulus.

In order to ensure that packer elements 6 remain permanently fixed in the compressed position depicted in FIG. 6, the weight of the small diameter casing should be allowed to rest on assembly 140 until the cement slurry placed in the small diameter/large diameter casing annulus hardens.

As will thus be apparent to those skilled in the art, this embodiment of the method of the present invention is also well suited for use in conjunction with a two-stage drilling process of the type described hereinabove.

Figure 8:
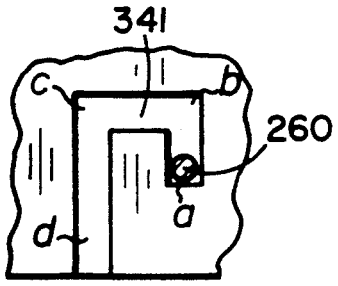
FIG. 8 illustrates a J-slot assembly 341 used in squeeze packer assembly 230.
Figure 7A:
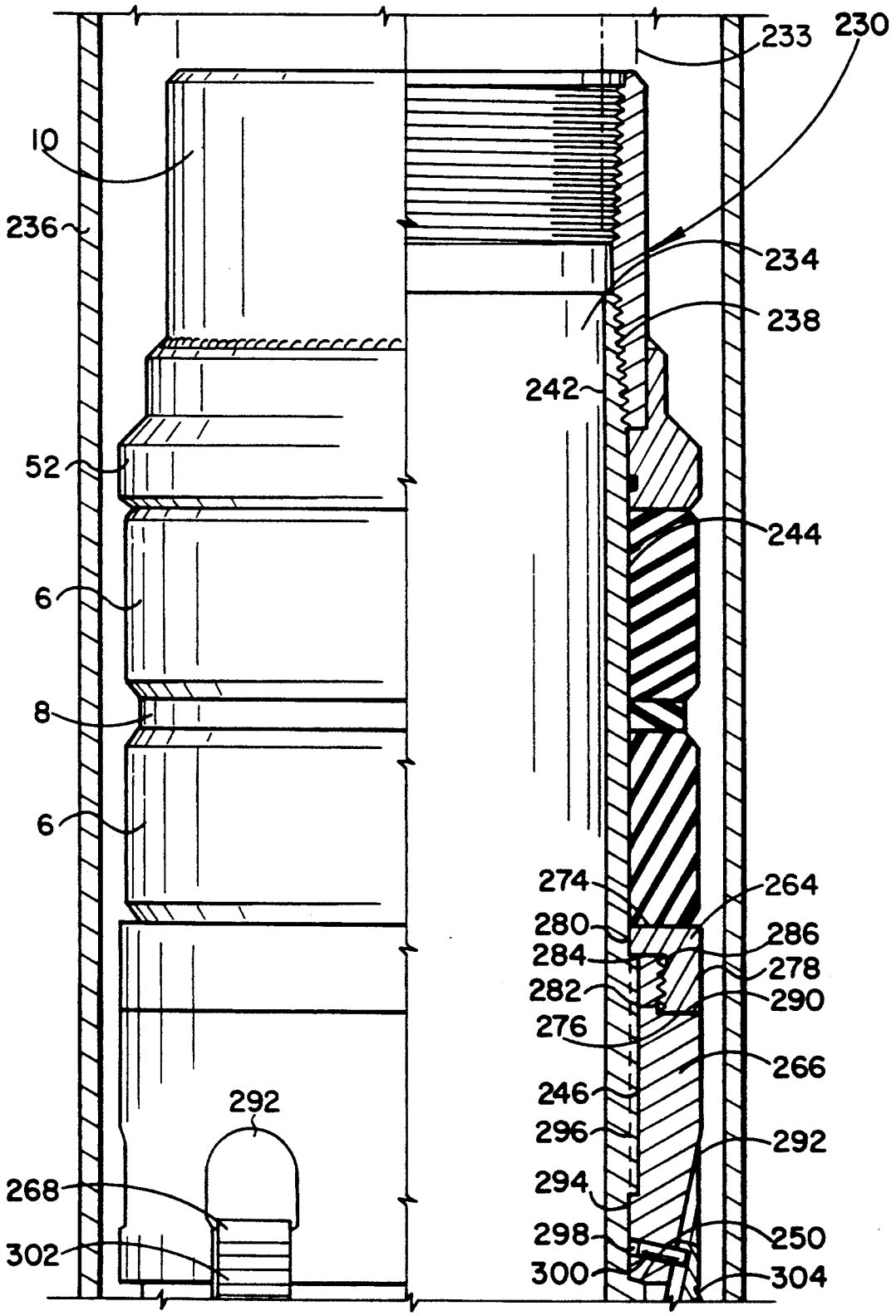
FIGS. 7A and 7B provide a one-half cutaway elevational side view of an embodiment of a fourth squeeze packer assembly 230 provided by and used in the present invention.
Figure 7B:
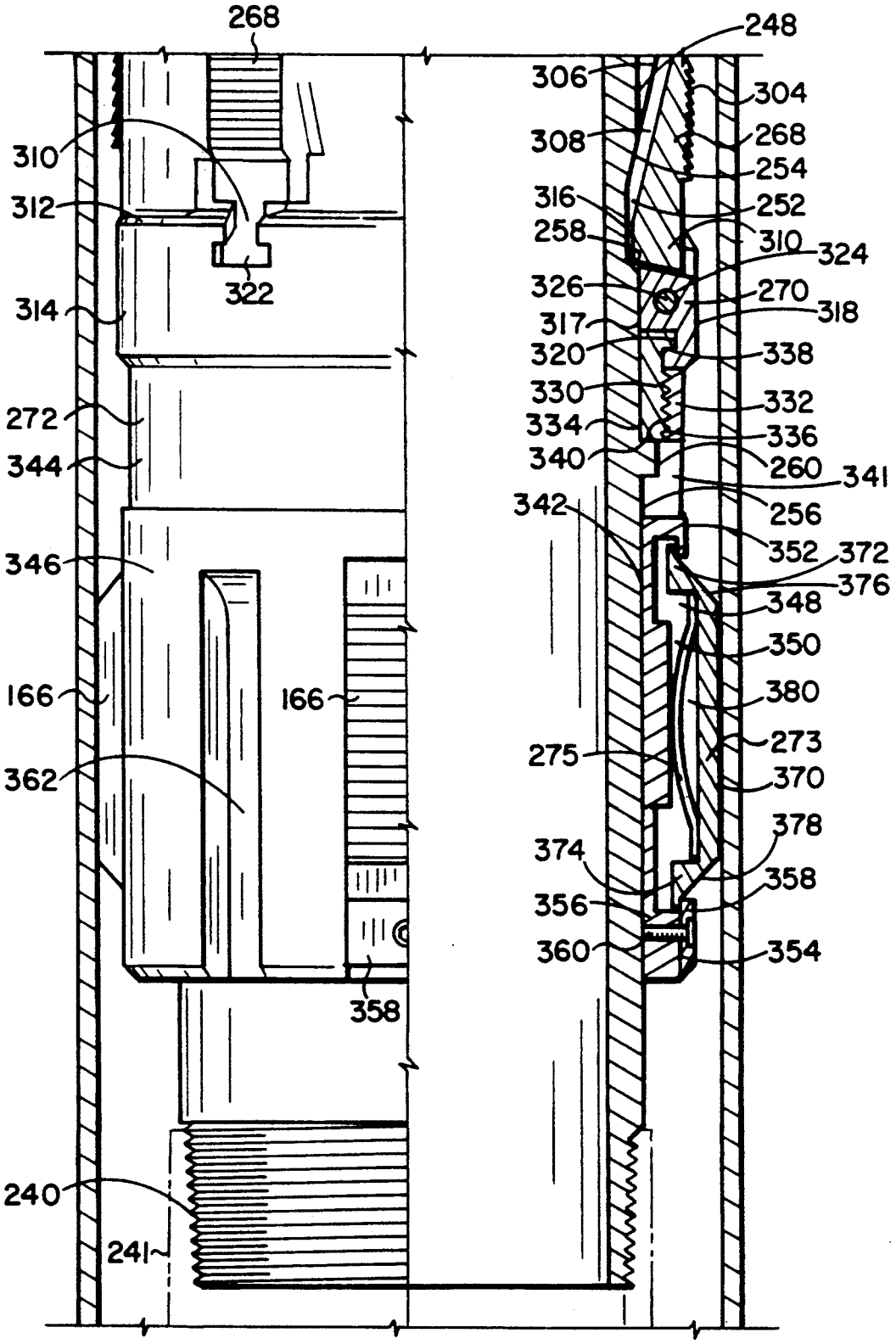

An embodiment of a fourth squeeze packer assembly 230 provided by and used in the present invention is depicted in FIGS. 7 and 8. Assembly 230 comprises: an elongate cylindrical housing (or mandrel) 232 having a passageway 234 extending longitudinally therethrough; a coupling 10 threadably connectable to one end of housing 232 for connecting assembly 230 to the end of a first casing joint 233 (shown in phantom in FIG. 7A); packer elements 6 positionable on the exterior of housing 232; a spacer 8 positionable on the exterior of housing 232 between packer elements 6; and a squeezing means, positionable on the exterior of housing 232, for compressing packer elements 6 into engagement with the interior wall of an outer casing 236. Coupling 10, packer elements 6, and spacer 8 are identical to the correspondingly numbered components of squeeze packer assembly 2. The squeezing means of squeeze packer assembly 230 comprises: an upper shoe 52 positionable above packer elements 6; a lower shoe 264 positionable below packer elements 6; a slip body 266 positionable beneath lower shoe 264; a plurality of slips 268 positionable adjacent slip body 266; a split ring retainer 270 for retaining slips 268 on housing 232; a drag block sleeve 272 positionable beneath retainer 270; and a plurality of drag blocks 273 and bow springs 275 positionable in sleeve 272. Upper shoe 52 of assembly 230 is identical to upper shoe 52 of squeeze packer assembly 2.

Housing 232 of squeeze packer assembly 230 comprises: a tapered exterior threaded portion 238 at one end thereof for threadingly connecting housing 232 to coupling 10; a tapered exterior threaded portion 240 at the other end thereof for threadingly connecting housing 232 to the end of a second casing joint 241 (shown in phantom in FIG. 7B); a cylindrical interior surface 242; a first cylindrical exterior surface 244 adjacent exterior threaded portion 238; a plurality of elongate splines 246 positioned on exterior surface 244; a second cylindrical exterior surface 248 adjacent surface 244, surface 248 having an outside diameter larger than the outside diameter of exterior surface 244; a frusto-conical exterior surface 250 extending from exterior surface 244 to exterior surface 248; a third cylindrical exterior surface 252 adjacent surface 248, surface 252 having an outside diameter smaller than the outside diameter of surface 248; a frusto-conical exterior surface 254 extending from cylindrical exterior surface 248 to cylindrical exterior surface 252; a fourth cylindrical exterior surface 256 adjacent exterior threaded portion 240, exterior surface 256 having an outside diameter larger than the outside diameter of exterior surface 252; a frusto-conical exterior surface 258 extending between exterior surface 252 and exterior surface 256; and a lug 260 projecting outwardly from exterior surface 256.

Lower shoe 264 of squeeze packer assembly 230 comprises: an upper radial surface 274 positionable adjacent packer elements 6; a lower radial surface 276; a cylindrical exterior surface 278 extending from the outer edge of upper radial surface 274 to the outer edge of lower radial surface 276; a cylindrical interior surface 280 extending from the interior edge of upper radial surface 274, surface 280 being positionable around exterior surface 244 of housing 232; and an interior threaded portion 282 extending from interior surface 280 to the inner edge of lower radial surface 276 for threadingly connecting lower shoe 264 to slip body 266.

Slip body 266 of squeeze packer assembly 230 comprises: an exterior threaded portion 286 for threadingly connecting slip body 266 to lower shoe 264; a cylindrical exterior surface 288 adjacent exterior threaded portion 286 and having an outside diameter larger than the outside diameter of threaded portion 286; a radial shoulder 290 defined by the transition from exterior threaded portion 286 to cylindrical exterior surface 288; tapered slots 292 formed in exterior surface 288 for contacting slips 268 and urging slips 268 against outer casing 236; and a cylindrical interior surface 294 positionable adjacent exterior surface 244 of housing 232. Grooves 296 are provided in interior surface 294 of slip body 266 for receiving splines 246 of housing 232. When splines 246 are positioned in grooves 296, slip body 266 is prevented from rotating on housing 232. Threaded apertures 298 are provided in tapered slots 292 for receiving screws 300.

Each slip 268 is an elongate wedge-shaped member having an exterior surface 302 with teeth 304 formed therein for gripping the interior surface of outer casing 236. Each slip 268 also has a tapered interior surface 306 having a groove 308 formed therein for receiving the head of a screw 300. Screws 300 operate to limit the travel of slip body 266 beneath slips 268. The lower end of each slip 268 comprises a T-shaped lug 310 which is positionable in split ring retainer 270.

Split ring retainer 270 of squeeze packer assembly 230 comprises: a tapered upper surface 312; a cylindrical exterior surface 314; a first cylindrical interior surface 316 extending from upper surface 312; and a second cylindrical interior surface 317 adjacent interior surface 316, surface 317 having an inside diameter larger than the inside diameter of surface 316. Interior surface 316 of retainer 270 has an inside diameter slightly greater than the outside diameter of exterior surface 252 of housing 232 such that surface 316 is positionable around surface 252. Interior surface 317 of retainer 270 has an inside diameter slightly greater than the outside diameter of exterior surface 256 of housing 232 such that surface 317 is positionable around surface 256. A connecting lip 318 having an interior groove 320 formed therein is provided on the bottom of retainer 270 for connecting retainer 270 to drag block sleeve 272. T-shaped slots 322 are formed in the upper portion of retainer 270 for receiving the T-shaped lugs 310 of slips 268.

Retainer 270 is preferably a split ring assembly comprised of a first semi-cylindrical portion connectable to a second semi-cylindrical portion. Threaded apertures 324 are provided through the ends of the semi-cylindrical portions such that the semi-cylindrical portions can be connected together using threaded members 326.

Drag block sleeve 272 of squeeze packer assembly 230 comprises an upper sleeve member 330 and a lower sleeve member 332. Lower sleeve member 332 is threadably connectable to upper sleeve member 330. Upper sleeve member 330 comprises: a cylindrical interior surface 334 which is positionable adjacent exterior surface 256 of housing 232, surface 334 extending from the upper end of sleeve member 330 to the lower end of member 330; a threaded exterior portion 336 extending from the lower end of member 330 for threadingly connecting upper sleeve member 330 to lower sleeve member 332; and a lip 338 projecting outward from the upper end of member 330. Lip 338 is receivable in groove 320 of retainer 270.

Lower sleeve member 332 of squeeze packer assembly 230 comprises: an upper interior threaded portion 340 for connecting lower sleeve member 332 to upper sleeve member 330; a cylindrical interior surface 342 extending from interior threaded portion 340 to the lower end of sleeve member 332; a first cylindrical exterior surface 344 extending from the upper end of lower sleeve member 332; and a second cylindrical exterior surface 346 extending from surface 344 to the lower end of sleeve member 332, surface 346 having an outside diameter larger than the outside diameter of surface 344. The inside diameter of interior surface 342 of sleeve member 332 is slightly greater than the outside diameter of exterior surface 256 of housing 232 such that surface 342 is positionable around surface 256. A J-slot 341 is formed in lower sleeve member 332 for receiving lug 260 of housing 232. J-slot 341 extends through lower sleeve member 332 from cylindrical exterior surface 344 to cylindrical interior surface 342. Cavities 348 are formed in cylindrical exterior surface 346 of sleeve member 332 for receiving drag blocks 273 and springs 275. Outwardly projecting surfaces 350 are provided in cavities 348 for contacting the bow portions of springs 170. Lips 352 extend across the upper ends of cavities 348.

Portions 354 are cut away from the lower portion of cylindrical exterior surface 346 so that drag blocks 273 and springs 275 can be positioned in cavities 348. Threaded apertures 356 are provided in cutaway portions 354 so that, after drag blocks 273 and springs 275 are placed in cavities 348, retaining plates 358 can be secured in cutaway portions 354 using screws 360. Retaining plates 358 and lips 352 operate to prevent drag blocks 273 and springs 275 from falling out of cavities 348.

Elongate grooves 362 are also provided in exterior surface 346 of lower sleeve member 332. Grooves 362 are provided to facilitate the flow of cement between drag blocks 273.

Each drag block 273 of assembly 230 is an elongate member comprising: an outside surface 370; an upper projecting end 372; a lower projecting end 374; a tapered upper surface 376 extending between upper end 372 and the upper edge of outside surface 370; a tapered lower surface 378 extending between lower end 374 and the lower edge of outside surface 370; and an interior recess 380 for receiving the ends of spring 275. When squeeze packer assembly 230 is assembled, upper ends 372 of drag blocks 273 are positioned beneath lips 352 of sleeve member 332 and lower ends 374 of drag blocks 273 are positioned beneath the upper ends of retaining plates 358. Consequently, lips 352 and retaining plates 358 operate to prevent drag blocks 273 from falling out of cavities 348.

A packer element squeezing means similar to the squeezing means of assembly 230 is disclosed in U.S. Pat. No. 4,619,319, the entire disclosure of which is incorporated herein by reference.

In a fourth embodiment of the method of the present invention, squeeze packer assembly 230 is used to facilitate the installation of a small diameter casing in a large diameter casing. In this embodiment of the inventive method, a large diameter casing is first run into a well bore. The large diameter casing is then cemented in place by pumping a cement slurry down the interior of the large diameter casing such that the cement slurry flows out of the lower end of the large diameter casing and then up and into the annulus between the exterior of the large diameter casing and the wall of the well bore. Squeeze packer assembly 230 is then incorporated in the small diameter casing with lug 260 abutting surface a of J-slot 341. As the small diameter casing is inserted into the large diameter casing, springs 275 of assembly 230 urge drag blocks 273 strongly against the interior surface of the large diameter casing. However, since lug 260 is positioned against surface a of J-slot 341 during the lowering process, drag blocks 273 are forced to slide down the interior surface of the large diameter casing as the small diameter casing is lowered into the large diameter casing.

When the small diameter casing has been lowered to a desired depth, a cement slurry is pumped down the interior of the small diameter casing such that the cement slurry flows out of the lower end of the small diameter casing and then up and into the annulus between the small diameter casing and the large diameter casing. As the cement slurry flows up the small diameter/large diameter casing annulus, a portion of the slurry flows around squeeze packer assembly 230 such that the column of cement placed in the small diameter/large diameter casing annulus extends from a point above squeeze packer assembly 230 to a point below squeeze packer assembly 230.

After an appropriate amount of cement has been placed in the small diameter/large diameter casing annulus, but before the slurry begins to harden, squeeze packer assembly 230 is mechanically operated in order to seal the annulus between the small diameter casing and the large diameter casing. Assembly 230 is mechanically operated by first lifting the small diameter casing slightly. During this lifting process, drag blocks 273 and drag block sleeve 272 remain in fixed position in the large diameter casing as a result of the force being exerted by drag blocks 273 and springs 275 against the interior surface of the large diameter casing. However, housing 232 of assembly 230 moves upward during the lifting process such that lug 260 is moved to position b in J-slot 341. With lug 260 thus positioned in J-slot 341, the small diameter casing is rotated such that lug 260 is moved to position c in J-slot 260. Subsequently, the weight of the inner casing is allowed to rest on squeeze packer assembly 230 such that lug 260 moves toward position d in J-slot 341.

As lug 260 moves toward position d, the weight of the small diameter casing urges upper shoe 52, packer elements 6, spacer 8, lower shoe 264, and slip body 266 downward with respect to slips 268, retainer 270, drag block sleeve 272, and drag blocks 273. As a result, slip body 266 slides beneath slips 268 and thereby forces the exterior surfaces 302 of slips 268 strongly against the interior surface of the large diameter casing. When thus urged against the interior surface of the large diameter casing, slips 268 operate to stop the downward movement of slip body 266 and lower shoe 264. However, although slip body 266 and lower shoe 264 are thus prevented from moving further downward, housing 232, coupling 10, and upper shoe 52 continue to move downward under the weight of the small diameter casing such that lug 260 moves further toward position d in J-slot 341. The downward movement of upper shoe 52 relative to lower shoe 264 compresses packer elements 6 of assembly 230 into sealing engagement with the interior of the large diameter casing.

As will thus be apparent to those skilled in the art, embodiment 4 of the inventive method is also well suited for use in conjunction with two-stage drilling processes of the type described hereinabove.

Thus, the present invention is well adapted to carry out the objects and obtain the ends and advantages mentioned above as well as those inherent therein. While numerous changes may be made by those skilled in the art, such changes are encompassed within the scope of the invention as defined by the appended claims.

What is claimed is:

1. An apparatus for casing a well comprising:

an outer casing;

an inner casing positionable inside said outer casing;

a squeeze packer assembly comprising an elongate housing having a passageway extending longitudinally therethrough, said elongate housing being incorporatable in said inner casing, a retaining member positionable on the exterior of said housing, a seating member positionable on the exterior of said housing, and at least one squeeze packer element positionable on the exterior of said housing between said retaining member and said seating member, said seating member being operable in conjunction with said retaining member for squeezing said squeeze packer element; and a contacting assembly comprising a contacting assembly housing incorporatable in said outer casing, said contacting assembly housing having a passageway extending longitudinally therethrough for receiving said inner casing and said passageway having an interior wall and a contacting member projecting inwardly from said interior wall of said contacting assembly housing, said contacting member being operable for contacting said seating member as said inner casing is inserted into said outer casing such that said seating member is prevented from being further inserted into said outer casing.

2. An apparatus as described in claim 1 wherein said squeeze packer assembly further comprises a locking means for locking said packer element in sealing position.

3. An apparatus as described in claim 2 wherein:

said squeeze packer assembly housing comprises an exterior surface having a groove formed therein;

said seating member comprises an interior surface which is slideably positionable adjacent said exterior surface, said interior surface having a groove formed therein;

said locking means comprises a locking ring positionable in one of said grooves; and the other of said grooves is operable for receiving a portion of said locking ring from said one groove to thereby lock said packer element in sealing position.

4. An apparatus as described in claim 1 wherein said contacting member is a segmented collar.

5. An apparatus as described in claim 1 wherein said retaining member and said seating member are packer shoes.

6. A packing assembly comprising:

an outer member having a passageway extending therethrough, said passageway having an interior wall;

an elongate inner member insertable in said passageway;

at least one squeeze packer element;

a retaining member positionable adjacent the exterior of said inner member;

a seating member positionable adjacent the exterior of said inner member; and a contacting member projecting inwardly from said interior wall of said outer member, wherein said squeeze packer element is positionable adjacent the exterior of said inner member between said retaining member and said seating member;

said seating member is operable in conjunction with said retaining member for squeezing said squeeze packer element; and said contacting member is operable for contacting said seating member as said inner member is inserted in said outer member passageway such that said contacting member prevents said seating member from being further inserted into said outer member passageway.

7. An assembly as described in claim 6 wherein said contacting member comprises a collar.

8. An assembly as described in claim 7 wherein said collar is a segmented collar.

9. An assembly as described in claim 6 further comprising a locking means for locking said squeeze packer element in its squeezed position.

10. An assembly as described in claim 6 wherein said outer member is incorporatable in a first casing string.

11. An assembly as described in claim 10 wherein:

said elongate inner member has a passageway extending longitudinally therethrough;

said elongate inner member is incorporatable in a second casing string;

said second casing string and said elongate inner member are receivable inside said first casing string; and said elongate inner member passageway substantially corresponds to the interior passageway of said second casing string.

12. An assembly as described in claim 9 wherein:

said inner member comprises an exterior surface having a groove formed therein;

said seating member comprises an interior surface which is slideably positionable adjacent said exterior surface, said interior surface having a groove formed therein;

said locking means comprises a locking ring positionable in one of said grooves; and the other of said grooves is operable for receiving a portion of said locking ring from said one groove to thereby lock said packer element in sealing position.

13. A packing assembly comprising:

an outer member having a passageway extending therethrough, said passageway having an interior wall and said interior wall having a cavity formed therein;

an elongate inner member insertable in said passageway;

at least one squeeze packer element positionable adjacent the exterior of said inner member; and a squeezing means, positionable adjacent the exterior of said inner member, for squeezing said squeeze packer element, said squeezing means including at least one outwardly biased contacting member, said cavity formed in said interior wall being operable for receiving an least a portion of said contacting member as said inner member is inserted into said outer member passageway and for retaining said contacting member such that said contacting member is prevented from being further inserted into said passageway and said squeezing means being mechanically operable for squeezing said packer element when said portion of said contacting member is received in said receiving means.

14. An assembly as described in claim 13 wherein said outwardly biased contacting member is a drag block.

15. An assembly as described in claim 13 wherein said outer member is incorporatable in a first casing.

16. An assembly as described in claim 12 wherein:

said elongate inner member has a passageway extending longitudinally therethrough;

said elongate inner member is incorporatable in a second casing;

said second casing is receivable inside said first casing; and said inner member passageway substantially corresponds to the interior passageway of said second casing.

17. A method of installing an inner casing inside an outer casing comprising the steps of:

(a) incorporating a mechanically operable squeeze packer assembly in said inner casing, said squeeze packer assembly comprising an elongate housing having a passageway extending longitudinally therethrough, said housing being incorporatable in said inner casing, a retaining member positionable on the exterior of said housing, a seating member positionable on the exterior of said housing, and at least one squeeze packer element positionable on the exterior of said housing between said retaining member and said seating member, said seating member being operable in conjunction with said retaining member for squeezing said squeeze packer element;

(b) incorporating a contacting member in said outer casing, said contacting member having a passageway extending therethrough for receiving said inner casing and for receiving said squeeze packer assembly and said contacting member including an inwardly projecting member positioned in said passageway for contacting said seating member as said squeeze packer assembly is inserted into said contacting member and for preventing said seating member from being further inserted into said outer casing; and (c) after step (b), inserting said inner casing in said outer casing until said seat member contacts said inwardly projecting member.

18. A method as described in claim 17 wherein, when said seating member is placed in contact with said inwardly projecting member, said method further comprises the step of (d) inserting said inner casing further into said outer casing such that said squeeze packer element is squeezed between said retaining member and said seating member.

19. A method as described in claim 14 wherein, when said inner casing is inserted in said outer casing, an annulus is formed between the exterior of said inner casing and the interior of said outer casing and wherein said method further comprises the step, prior to step (d), of placing cement into said annulus.

20. A method as described in claim 19 further comprising the steps, prior to step (a), of: inserting said outer casing into a well bore and cementing said outer casing in said well bore., an annulus is formed between the exterior of said inner casing and the interior of said outer casing and wherein said method further comprises the step, prior to step (d), of placing cement into said annulus.

21. An apparatus for casing a well comprising:

an outer casing;

an inner casing positionable in said outer casing;

a squeeze packer assembly comprising an elongate housing having a passageway extending longitudinally therethrough, said elongate housing being incorporatable in said inner casing, a retaining member positionable on the exterior of said housing, a squeezing assembly positionable on the exterior of said housing, said squeezing assembly including an outwardly biased contacting member, and at least one squeeze packer element positionable on the exterior of said housing between said retaining member and said squeezing assembly, said squeezing assembly being operable in conjunction with said retaining member for squeezing said packer element; and a retaining housing positionable in said outer casing, said retaining housing having: a passageway extending therethrough for receiving said inner casing, an interior wall, and a cavity formed in said interior wall for receiving and retaining said outwardly biased contacting member such that said squeezing assembly is prevented from being further inserted into said outer casing.

22. An apparatus as described in claim 21 wherein said outwardly biased contacting member is a drag block.

23. An apparatus as described in claim 22 wherein said squeezing assembly further comprises a drag block sleeve having an aperture formed therein through which said drag block projects.

24. A method of installing an inner casing inside an outer casing comprising the steps of:

(a) incorporating a mechanically operable squeeze packer assembly in said inner casing, said squeeze packer assembly comprising an elongate housing having a passageway extending longitudinally therethrough, said housing being incorporatable in said inner casing, a retaining member positionable on the exterior of said housing, a squeezing assembly positionable on the exterior of said housing, said squeezing assembly including an outwardly biased contacting member, and at least one squeeze packer element positionable on the exterior of said housing between said retaining member and said squeezing assembly, said squeezing assembly being operable in conjunction with said retaining member for squeezing said squeeze packer element;

(b) incorporating a receiving member in said outer casing, said receiving member having a passageway extending therethrough for receiving said inner casing and for receiving said squeeze packer assembly, said receiving member passageway having an interior wall, and said interior wall having a cavity formed therein for receiving and retaining said outwardly biased contacting member such that said squeezing assembly is prevented from being further inserted into said outer casing; and (c) after step (b), inserting said inner casing in said outer casing until said outwardly biased contacting member is received in said cavity.

25. A method as described in claim 24 wherein, when said outwardly biased contacting member is received in said cavity, said method further comprise the step of (d) inserting said inner casing further into said outer casing such that said squeeze packer element is squeezed between said retaining member and said squeezing assembly.

26. A method as described in claim 225 wherein, when said inner casing is inserted in said outer casing, an annulus is formed between the exterior of said inner casing and the interior of said outer casing and wherein said method further comprises the step, prior to step (d), of placing cement into said annulus.

27. A method as described in claim 26 further comprising the steps, prior to step (a), of:

inserting said outer casing into a well bore and cementing said outer casing in said well bore.

* * * * *

UNITED STATES PATENT AND TRADEMARK OFFICE

CERTIFICATE OF CORRECTION

PATENT NO. : 5,261,492

DATED : November 16, 1993

INVENTOR(S) : Duell Et Al.

It is certified that error appears in the above-identified patent and that said Letters Patent is hereby corrected as shown below:

Move all text beginning with the word "receiving" in col. 11, line 54 and ending with the word "and" in col. 12, line 29 to col. 11, line 11 between the words "for" and "cylindrical".

Col. 19, claim 20, lines 61-65, delete ", an annulus is formed between the exterior of said inner casing and the interior of said outer casing and wherein said method further comprises the step, prior to step (d), of placing cement into said annulus.".

Col. 21, claim 26, line 3, change "225" to --25--.

Signed and Sealed this

Thirty-first Day of May, 1994

*Attest:*

Bruce Lehman

BRUCE LEHMAN

*Attesting Officer*

*Commissioner of Patents and Trademarks*